US005692051A

United States Patent [19]

Schott

[11] Patent Number: 5,692,051

[45] Date of Patent: Nov. 25, 1997

[54] ELECTRONIC EQUALIZATION FOR RECESSED LOUDSPEAKER MOUNTING

[75] Inventor: Wayne M. Schott, Seymour, Tenn.

[73] Assignee: Philips Electronics North America Corporation, New York, N.Y.

[21] Appl. No.: 677,003

[22] Filed: Jul. 8, 1996

[51] Int. Cl.[6] ..... H04R 5/00

[52] U.S. Cl. ..... 381/1; 381/98; 381/103; 333/28 T

[58] Field of Search ..... 381/24, 1, 98, 381/101, 102, 103, 106; 333/28 R, 28 T; 348/738

[56] References Cited

U.S. PATENT DOCUMENTS

| | | | |
|---|---|---|---|
| 3,130,374 | 4/1964 | Beres et al. | 381/101 |
| 3,732,373 | 5/1973 | Boyden | 381/102 |
| 4,316,060 | 2/1982 | Adams et al. | 381/98 |
| 4,891,841 | 1/1990 | Bohn | 381/98 |
| 5,103,315 | 4/1992 | Kufta et al. | 348/738 |
| 5,282,252 | 1/1994 | Orban | 381/98 |

*Primary Examiner*—Curtis Kuntz
*Assistant Examiner*—Ping W. Lee
*Attorney, Agent, or Firm*—Edward W. Goodman

[57] ABSTRACT

An equalizing circuit, for compensating frequency response perturbations in a loudspeaker caused by a recessed mounting of the loudspeaker, includes an input for receiving an audio signal, a peaking network coupled to the input for augmenting the audio signal in a first frequency range, a dipping network also coupled to the input for attenuating the audio signal in a second frequency range, and a combiner for combining an output of the peaking network to an output of the dipping network, an output of the combiner carrying a compensated audio signal for application to the loudspeaker.

19 Claims, 6 Drawing Sheets

ELECTRONIC EQUALIZATION FOR RECESSED LOUDSPEAKER MOUNTING

BACKGROUND OF THE INVENTION

1. Field of The Invention

The subject invention relates to the frequency response of loudspeakers when mounted in a recessed baffle arrangement.

In television receivers, it is desirable to have loudspeakers strategically mounted in the cabinet so that the user may hear a pleasing rendition of the audio portion of television programs being displayed. However, due to the esthetic designs of the cabinet and the available location(s) for the speakers, the shortened tunnel that results in such locations causes the frequency response of the loudspeaker to be perturbed in a relatively predictable manner.

In general, the mid-range response in the 1 kHz to 2 kHz range tends to be augmented, while the response in the 3 kHz to 6 kHz range tends to be decreased.

2. Description of The Related Art

U.S. Pat. No. 4,709,391 discloses an arrangement for converting an electric signal into an acoustic signal or vice versa and a non-linear network for reducing distortion in the output signal of the arrangement, the distortion being caused by the electro-acoustic conversion performed by an electro-acoustic transducer in the arrangement. In particular, the non-linear network is arranged for reducing non-linear distortion by compensating for at least a second or higher order distortion component in the output signal of the arrangement.

While this arrangement effectively reduces the distortions in the output signal based on the predicted distortions of the process of electro-acoustic transducing, this solution does not address the effects that the mounting environment may have on the output signal of the transducer.

SUMMARY OF THE INVENTION

An object of the invention is to provide an equalizing circuit for compensating frequency response perturbations in a loudspeaker caused by a recessed mounting of the loudspeaker.

In particular, it is an object of the invention to provide an equalizing circuit for compensating the augmented and decreased portions of the frequency response of a loudspeaker in a recessed mounting.

This object is achieved in an equalizing circuit comprising an input for receiving an audio signal; a peaking network coupled to said input for augmenting the audio signal in a first frequency range; a dipping network coupled to said input for attenuating the audio signal in a second frequency range; and means for combining an output of said peaking network to an output of said dipping network, an output of said combining means carrying a compensated audio signal for application to said loudspeaker.

Alternatively, the object is achieved in an equalizing circuit comprising an input for receiving an audio signal; a peaking network coupled to said input for augmenting the audio signal in a first frequency range; and a dipping network coupled to an output of said peaking network for attenuating the audio signal in a second frequency range, an output of said dipping network carrying a compensated audio signal for application to said loudspeaker.

Applicant has found that by combining a peaking network with a dipping network, the overall acoustic response of loudspeakers installed in many television cabinet designs can be restored to a flattened condition. The placement of the tuned frequencies of the peaking and dipping networks may be adjusted to match each particular cabinet design by simply modifying the values of the components in the networks.

BRIEF DESCRIPTION OF THE DRAWINGS

With the above and additional objects and advantages in mind as will hereinafter appear, the invention will be described with reference to the accompanying drawings, in which:

FIG. 5A shows a response curve of a loudspeaker in a television cabinet without the equalizing circuit of the subject invention, while

DESCRIPTION OF THE PREFERRED EMBODIMENTS

Figure 1:
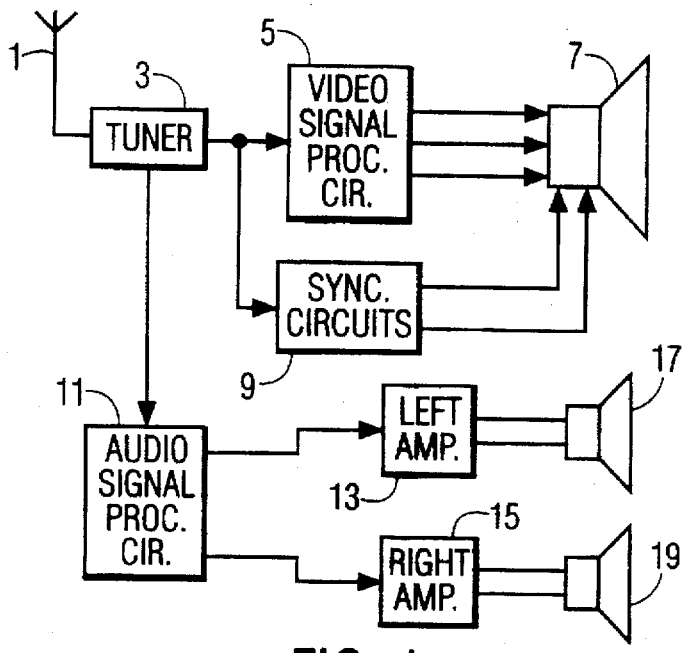
FIG. 1 shows a block diagram of a typical television receiver.

FIG. 1 shows a circuit block diagram of a television receiver. Television signals are received by an antenna 1 and applied to a tuner 3. Alternatively, the television signals may be applied to the tuner 3 by a cable connection, a video cassette recorder, etc. An output from the tuner 3 carrying the video signal is applied to a video signal processing circuit 5 for generating color signals (R, G, B) which are applied to a display, shown as CRT 7. In addition, the video signal from the tuner 3 is applied to synchronization circuits 9 for generating horizontal and vertical synchronizing signals for the CRT 7.

A second output from the tuner 3 carries audio signals for application to an audio signal processing circuit 11. In the case of stereo, the audio signal processing circuit 11 forms a left channel signal, applied to a left audio amplifier 13, and a right channel signal, applied to a right audio amplifier 15. A left channel speaker 17 is connected to outputs from the left audio amplifier 13 while a right channel speaker 19 is connected to outputs from the right audio amplifier 15.

Figure 2:
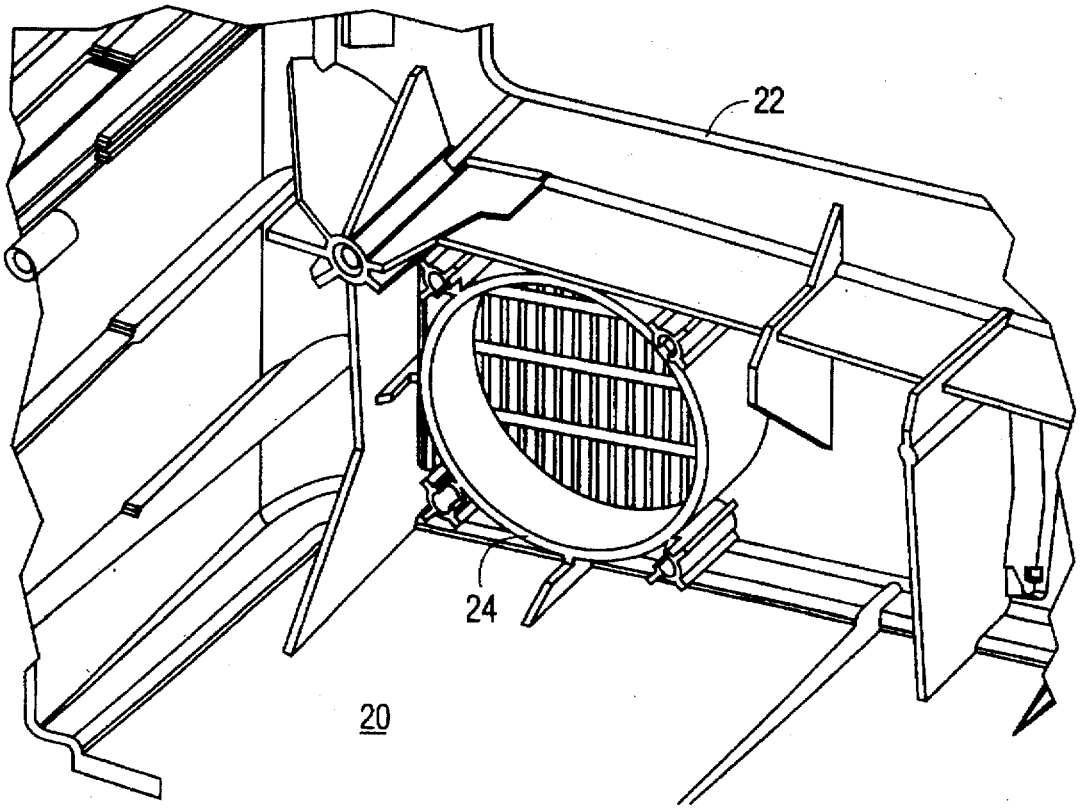
FIG. 2 shows a perspective view of a cabinet within which the television receiver of FIG. 1 may be mounted.

FIG. 2 shows a perspective drawing of a portion of the inside of a cabinet 20 into which the components of the television receiver of FIG. 1 may be mounted. In particular, the cabinet 20 includes an opening 22 into which the CRT 7 is be mounted, and an area 24 where the right speaker 19 is to be mounted. The cabinet 20 further includes a corresponding area (not shown) where the left speaker 17 is to be mounted. Due to the configuration of the cabinet 20 in the area 24, a shortened tunnel results which has an adverse effect on the performance of the speaker 19 (and similarly with speaker 17) mounted therein. Notably, the shortened tunnel configuration causes the mid-range response of the speakers 17 and 19 in the 1 kHz to 2 kHz range to be augmented, and the response of the speakers 17 and 19 in the 2 kHz to 6 kHz range to be decreased.

The purpose of the subject invention is to compensate for these perturbations of the frequency response. To that end, the subject invention provides an equalizing circuit for insertion into the audio signal line of the television receiver as shown in FIG. 1. This may be between the audio signal processing circuit 11 and the left and right audio amplifiers 13 and 15, or between the left and right audio amplifiers 13 and 15 and the left and right speakers 17 and 19, respectively.

Figure 3A:
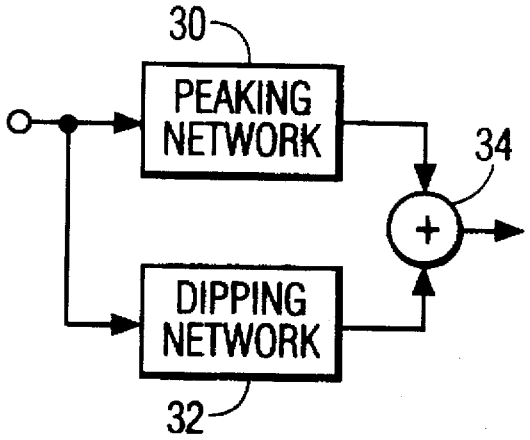
FIG. 3A shows a first embodiment of the invention.

FIG. 3A shows a block diagram of a first embodiment of the invention in which an audio signal is applied to an input of a peaking network 30 and to an input of a dipping network 32. The peaking network 30 is dimensioned such that it operates on a first frequency range of the audio signal to augment (or boost) the frequency response of the audio signal in that frequency range. This first frequency range is the same frequency range within which the audio signal is decreased due to the perturbations to the frequency response caused by the mounting position in the television receiver cabinet 20. It has been found, in practice, that the first frequency range is approximately 3 kHz to 6 kHz.

The dipping network 32, on the other hand, is dimensioned such that it operates on a second frequency range of the audio signal to decrease the frequency response of the audio signal in that frequency range. This second frequency range is the same frequency range within which the audio signal is augmented due to the perturbations to the frequency response caused by the mounting position in the television receiver cabinet 20. It has been found that the second frequency range is approximately 1 kHz to 2 kHz.

Outputs from the peaking network 30 and the dipping network 32 are applied to respective inputs of a combining circuit shown in FIG. 3A as an adder 34. An output from the adder 34 carries the equalized audio signal for application to a loudspeaker.

Figure 3B:
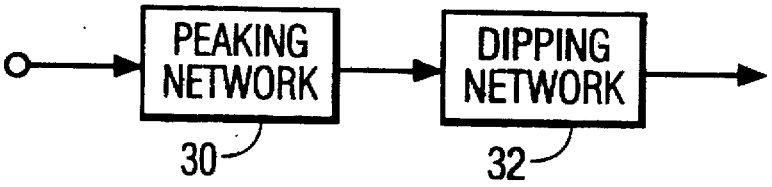
FIG. 3B shows a second embodiment of the invention.

FIG. 3B shows a second embodiment of the invention in which the audio signal is applied directly to the peaking network 30. Since the first and second frequency ranges do not overlap, the output from the peaking network 30 is applied directly to the input of the dipping network 32, and the adder 34 may be eliminated. As such, the output from the dipping network 32 forms the output from the equalizing circuit.

Figure 3C:
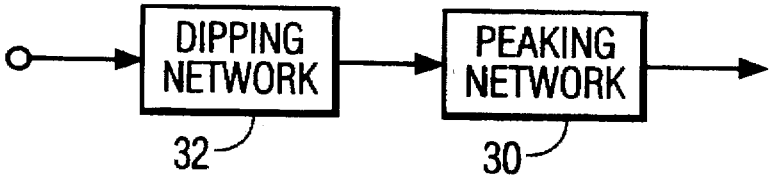
FIG. 3C shows a third embodiment of the invention.

FIG. 3C shows a third embodiment of the invention which is substantially similar to the second embodiment with the exception that the positions of the peaking network 30 and the dipping network 32 are interchanged.

Figure 4:
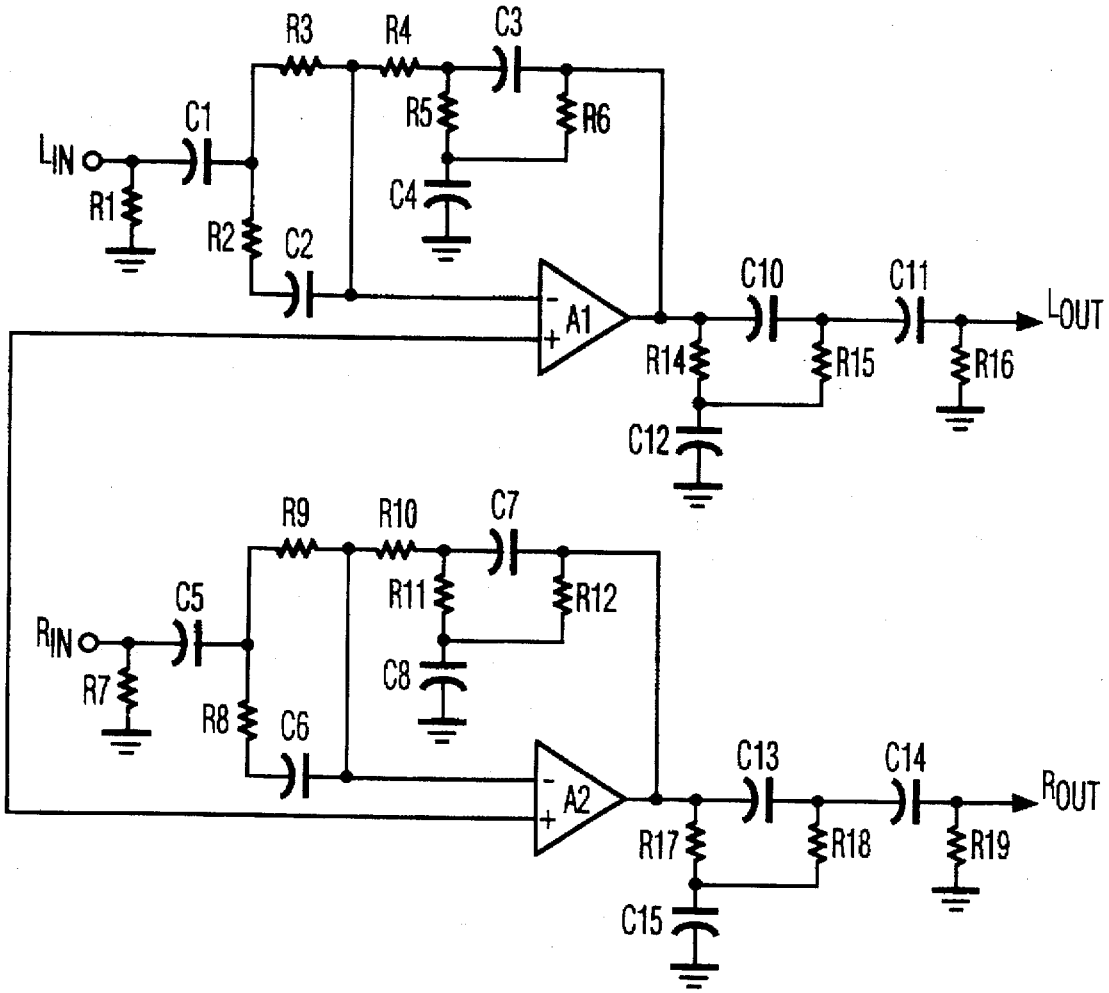
FIG. 4 shows schematic diagram of a stereo implementation of the second embodiment of the invention, as shown in FIG. 3B, in which the dipping network uses passive components.

FIG. 4 shows a schematic diagram of a first stereo implementation of the second embodiment of the equalizing circuit. A left audio signal is applied to an input terminal $L_{IN}$ which is connected to ground by a resistor R1. The input terminal $L_{IN}$ is also connected to an inverting input of operational amplifier (OP-AMP) A1 through a series arrangement of a capacitor C1, a resistor R2 and a capacitor C2. A resistor R3 further connects the junction between capacitor C1 and resistor R2 to the inverting input of OP-AMP A1. The output from OP-AMP A1 is fed back to its inverting input through the series arrangement of a capacitor C3 and a resistor R4, in which the junction between capacitor C3 and resistor R4 is connected to ground through a series arrangement of a resistor R5 and a capacitor C4. The output from OP-AMP A1 is further connected to the junction between resistor R5 and capacitor C4 through a resistor R6.

Similarly, a right audio signal is applied to an input terminal $R_{IN}$ which is connected to ground by a resistor R7. The input terminal $R_{IN}$ is also connected to an inverting input of operational amplifier (OP-AMP) A2 through a series arrangement of a capacitor C5, a resistor R8 and a capacitor C6. A resistor R9 further connects the junction between capacitor C5 and resistor R8 to the inverting input of OP-AMP A2. The output from OP-AMP A2 is fed back to its inverting input through the series arrangement of a capacitor C7 and a resistor R10, in which the junction between capacitor C7 and resistor R10 is connected to ground through a series arrangement of a resistor R11 and a capacitor C8. The output from OP-AMP A2 is further connected to the junction between resistor R11 and capacitor C8 through a resistor R12. The non-inverting inputs of OP-AMP's A1 and a2 are interconnected and connected to ground through the parallel combination of resistor R13 and capacitor C9.

The components thus far discussed form separate peaking networks for the left and right channels, respectively.

The left channel dipping network is formed by a series arrangement of capacitors C10 and C11 connected between the output of OP-AMP A1 and an output terminal $L_{OUT}$. The input terminal of capacitor C10 is further connected to ground through the series combination of a resistor R14 and a capacitor C12. The junction between capacitors C10 and C11 is connected to the junction between resistor R14 and capacitor C12 by a resistor R15. Finally, the output terminal $L_{OUT}$ is connected to ground by resistor R16.

Similarly, the right channel dipping network is formed by a series arrangement of capacitors C13 and C14 connected between the output of OP-AMP A2 and an output terminal $R_{OUT}$. The input terminal of capacitor C13 is further connected to ground through the series combination of a resistor R17 and a capacitor C15. The junction between capacitors C13 and C14 is connected to the junction between resistor R17 and capacitor C15 by a resistor R18. Finally, the output terminal $R_{OUT}$ is connected to ground by resistor R19.

In this implementation, the components may have the following values:

| RESISTORS | |
|---|---|
| R1, R2, R7, R8, R16, R19 | 100 kohms |
| R3, R9 | 27 kohms |
| R4, R10 | 24 kohms |
| R5, R6, R11, R12 | 2 kohms |
| R13 | 1 kohms |
| R14, R15, R17, R18 | 1.4 kohms |
| **CAPACITORS** | |
| C1, C5 | 2 μF |
| C2, C6 | 1000 pF |
| C3, C7 | .01 μF |
| C4, C8 | .047 μF |
| C9 | 100 μF |
| C10, C13 | .022 μF |
| C11, C14 | 5 μF |
| C12, C15 | .15 μF |

Figure 5A:
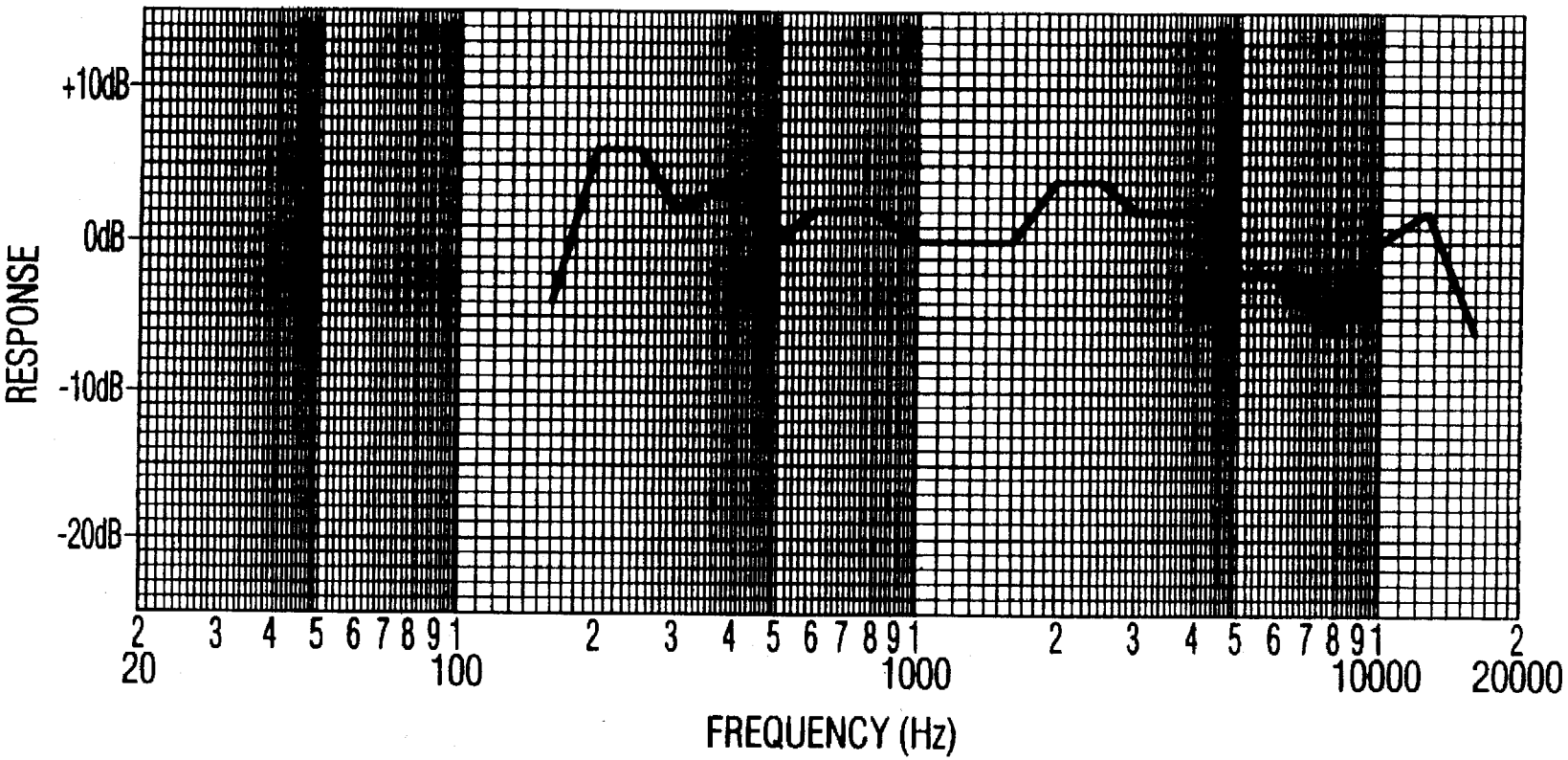
Figure 5B:
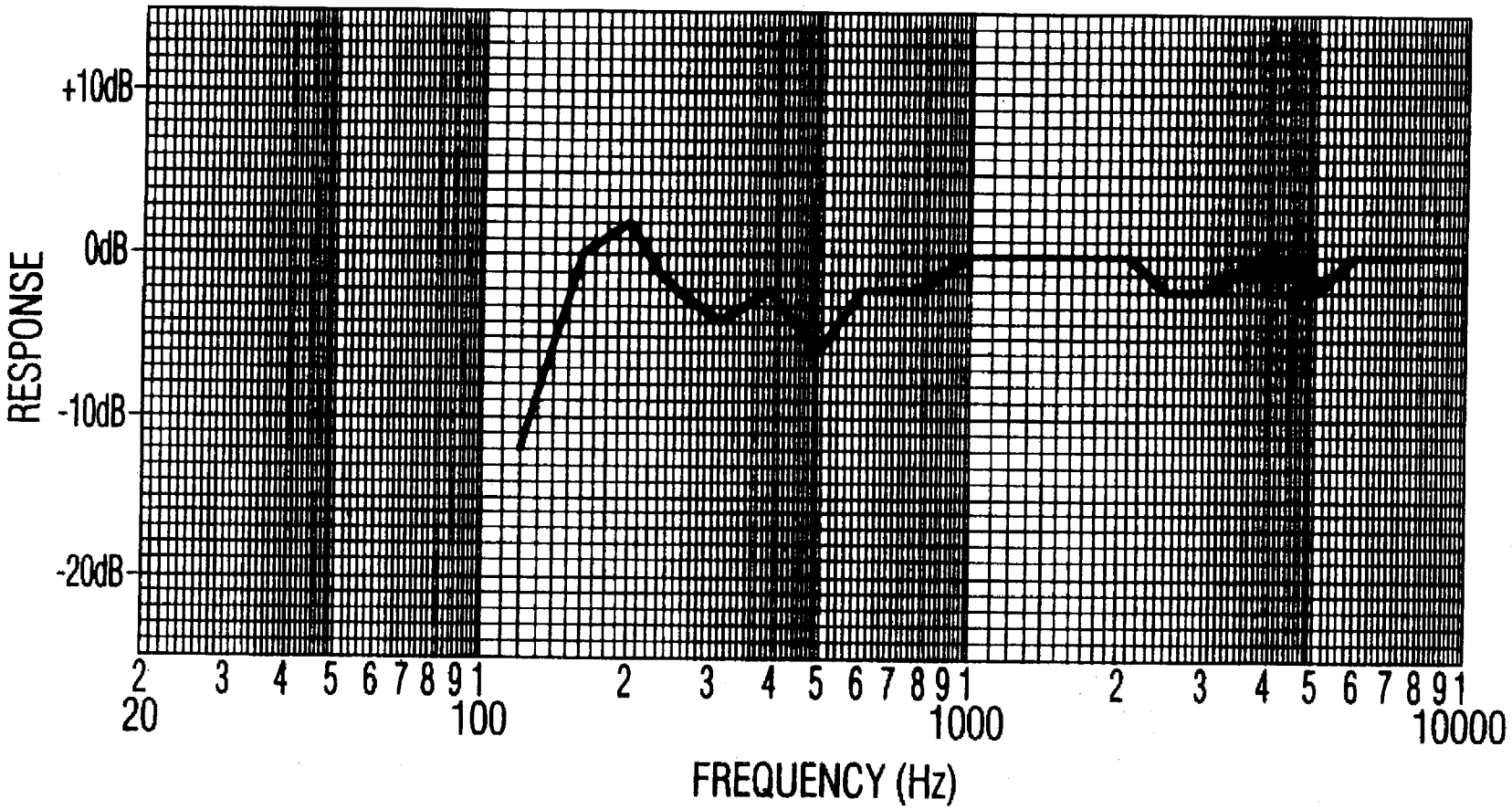
FIG. 5B shows a response curve of the same loudspeaker in the same television cabinet with the equalizing circuit.

FIG. 5A shows the frequency response of a loudspeaker mounted the television cabinet 20. In examining the frequency response curve, one should note the augmented portion thereof at approximately 2 kHz, as well as the attenuated portion at approximately 8 kHz. In contrast therewith, FIG. 5B shows the frequency response of the same loudspeaker in the same television cabinet 20 which has been equalized using the above implementation of the equalizing circuit. One should note that the frequency response curve is substantially flat from 1 kHz to the upper limits of the loudspeaker.

Figure 6:
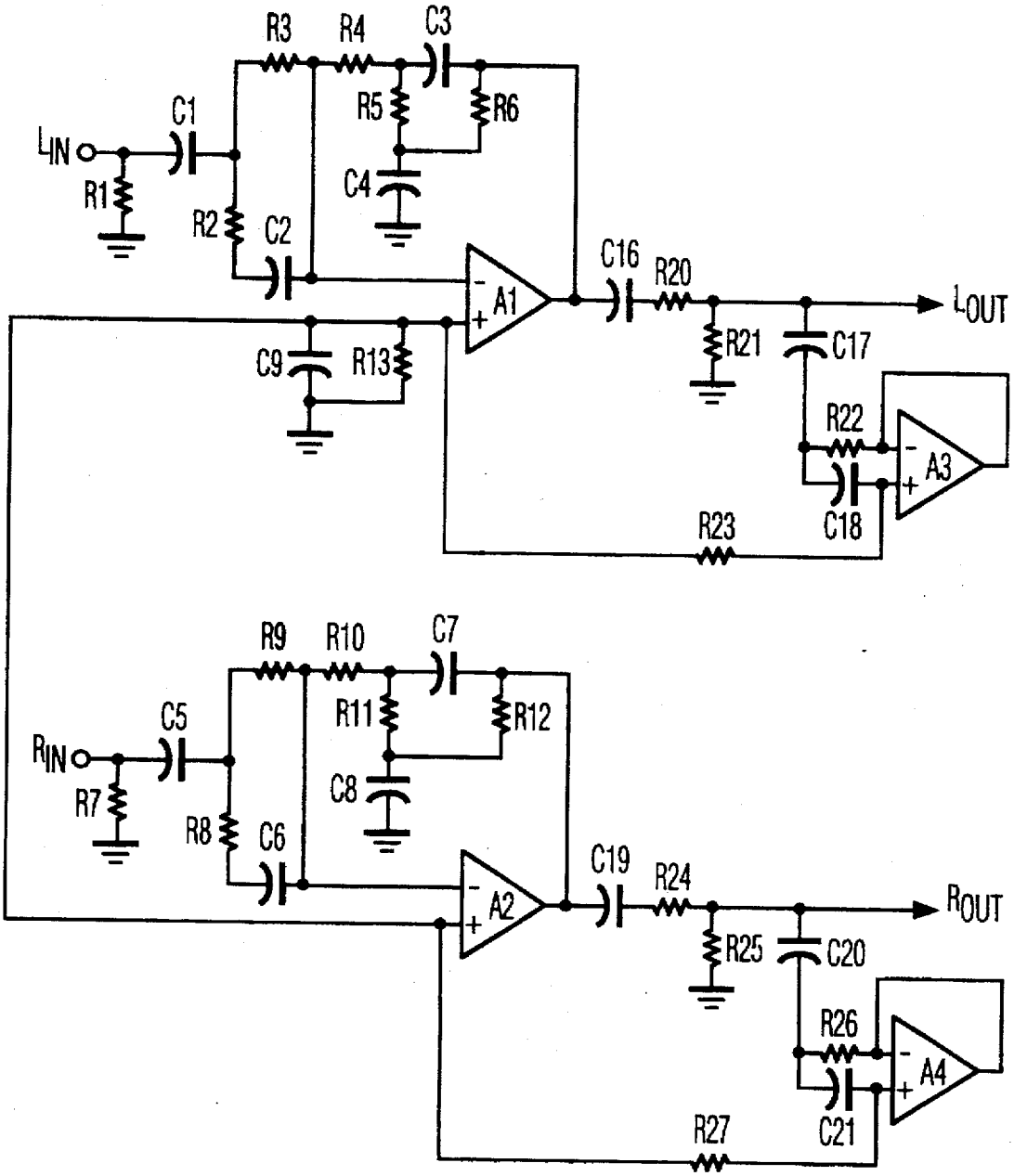
FIG. 6 shows a stereo implementation of the second embodiment of the invention, as in FIG. 3B, in which the dipping network uses active components.

FIG. 6 shows a second stereo implementation of the second embodiment of the equalizing circuit of the subject invention, in which the same parts carry the same reference numbers. In particular, the peaking networks remain the same. However, the dipping networks are effected by active circuits. The output from OP-AMP A1 is now connect through a capacitor C16 to ground through a series arrangement of resistors R20 and R21. The junction between resistors R20 and R21, which is connected to output terminal $L_{OUT}$, is also connected to one end of a capacitor C17. The other end of capacitor C17 is connected to the inverting input of OP-AMP A3 through a resistor R22, and to the non-inverting input through a capacitor C18. The output of OP-AMP A3 is connected to its inverting input. A resistor R23 connects the non-inverting input of OP-AMP A3 to the non-inverting input of OP-AMP A1. Connected as such, OP-AMP A3, along with capacitors C17 and C18 and resistors R22 and R23, forms a resonant circuit.

Similarly, the output from OP-AMP A3 is now connect through a capacitor C19 to ground through a series arrangement of resistors R24 and R25. The junction between resistors R24 and R25, which is connected to output terminal $R_{OUT}$, is also connected to one end of a capacitor C20. The other end of capacitor C20 is connected to the inverting input of OP-AMP A4 through a resistor R26, and to the non-inverting input through a capacitor C21. The output of OP-AMP A4 is connected to its inverting input. A resistor R27 connects the non-inverting input of OP-AMP A4 to the non-inverting input of OP-AMP A2. Connected as such, OP-AMP A4, along with capacitors C20 and C21 and resistors R26 and R27, forms as a resonant circuit.

In this implementation, the components may have the following values:

| RESISTORS | |
|---|---|
| R1, R7 | 100 kohms |
| R2, R8 | 47 kohms |
| R3, R9 | 22 kohms |
| R4, R10 | 33 kohms |
| R5, R6, R11, R12 | 10 kohms |
| R13 | 1 kohms |
| R20, R24 | 39 kohms |
| R21, R25 | 27 kohms |
| R22, R26 | 3.3 kohms |
| R23, R27 | 130 kohms |
| **CAPACITORS** | |
| C1, C5 | 2 μF |
| C2, C6 | 1000 pF |
| C3, C7 | .0022 μF |
| C4, C8 | .0068 μF |
| C9 | 100 μF |
| C16, C19 | 5 μF |
| C17, C18, C20, C21 | .0047 μF |

Numerous alterations and modifications of the structure herein disclosed will present themselves to those skilled in the art. However, it is to be understood that the above described embodiments are for purposes of illustration only and not to be construed as a limitation of the invention. All such modifications which do not depart from the spirit of the invention are intended to be included within the scope of the appended claims.

What is claimed is:

1. A television receiver comprising:

a tuner for receiving and tuning to a television signal;

a video signal processing circuit coupled to a first output of said tuner for processing a video component of said television signal, said video signal processing circuit generating at least one display signal;

display means coupled to said video signal processing circuit for displaying said at least one display signal;

synchronizing signal generating means also coupled to said first output of said tuner for generating synchronizing signals for controlling said display means;

an audio signal processing circuit coupled to a second output of said tuner for processing an audio component of said television signal; said audio signal processing circuit generating at least one audio signal;

at least one loudspeaker coupled to an output of said audio signal processing circuit for reproducing the at least one audio signal;

a cabinet within which at least said at least one loudspeaker is mounted; and an equalizing circuit for compensating frequency response perturbations in said at least one loudspeaker caused by a recessed mounting of said at least one loudspeaker in said cabinet, said equalizing circuit comprising:

an input for receiving the audio signal;

a peaking network coupled to said input for augmenting the audio signal in a first frequency range;

a dipping network coupled to said input for attenuating the audio signal in a second frequency range; and means for combining an output of said peaking network to an output of said dipping network, an output of said combining means carrying a compensated audio signal for application to said loudspeaker.

2. A television receiver as claimed in claim 1, wherein said first frequency range is higher than said second frequency range.

3. A television receiver as claimed in claim 2, wherein said first frequency range is from 3 kHz to 6 kHz.

4. A television receiver as claimed in claim 2, wherein said second frequency range is from 1 kHz to 2 kHz.

5. A television receiver as claimed in claim 1, wherein said audio signal is a stereo audio signal having a left channel signal and a right channel signal, said left channel signal being applied to said peaking network and to said dipping network, and the output of said combining means carrying a compensated left channel signal, and wherein said equalizing circuit further comprises:

a further input for receiving said right channel signal;

a further peaking network coupled to said further input for augmenting the right channel signal in the first frequency range;

a further dipping network also coupled to said further input for attenuating the right channel signal in the second frequency range; and further combining means for combining an output of said further peaking network to an output of said further dipping network, an output of said further combining means carrying a compensated right channel signal.

6. A television receiver comprising:

a tuner for receiving and tuning to a television signal;

a video signal processing circuit coupled to a first output of said tuner for processing a video component of said television signal, said video signal processing circuit generating at least one display signal;

display means coupled to said video signal processing circuit for displaying said at least one display signal;

synchronizing signal generating means also coupled to said first output of said tuner for generating synchronizing signals for controlling said display means;

an audio signal processing circuit coupled to a second output of said tuner for processing an audio component of said television signal; said audio signal processing circuit generating at least one audio signal;

at least one loudspeaker coupled to an output of said audio signal processing circuit for reproducing the at least one audio signal;

a cabinet within which at least said at least one loudspeaker is mounted; and an equalizing circuit for compensating frequency response perturbations in said at least one loudspeaker caused by a recessed mounting of said at least one loudspeaker in said cabinet, said equalizing circuit comprising:

an input for receiving the audio signal;

a peaking network coupled to said input for augmenting the audio signal in a first frequency range; and a dipping network coupled to an output of said peaking network for attenuating the audio signal in a second frequency range, an output of said dipping network carrying a compensated audio signal for application to said loudspeaker.

7. A television receiver as claimed in claim 6, wherein said first frequency range is higher than said second frequency range.

8. A television receiver as claimed in claim 7, wherein said first frequency range is from 3 kHz to 6 kHz.

9. A television receiver as claimed in claim 7, wherein said second frequency range is from 1 kHz to 2 kHz.

10. A television receiver as claimed in claim 6, wherein said dipping network is a passive circuit.

11. A television receiver as claimed in claim 10, wherein said dipping network comprises:

a series arrangement of a first and a second capacitor coupled between the input and the output of the dipping network;

a series arrangement of a first resistor and a third capacitor connecting the input of the dipping network to ground;

a second resistor connecting a junction point between said first and second capacitors to a junction point between said first resistor and said third capacitor; and a third resistor connecting the output of the dipping network to ground.

12. A television receiver as claimed in claim 6, wherein said dipping network is an active circuit.

13. A television receiver as claimed in claim 12, wherein said dipping circuit comprises:

a series arrangement of a first capacitor, a first resistor and a second resistor coupled between the input and ground;

a second capacitor having a first terminal coupled to a junction between the first and second resistors, and a second terminal;

an operational amplifier having an inverting input, a non-inverting input and an output, said output being fed back to the inverting input;

a third resistor coupling the second terminal of said second capacitor to the inverting input of said operational amplifier;

a third capacitor coupling the second terminal of the second capacitor to the non-inverting input of said operational amplifier; and and a combination of a fourth resistor in series with a parallel arrangement of a fifth resistor and a capacitor coupling the non-inverting input of said operational amplifier to ground, wherein the junction between the first and second resistors forms the output of the dipping network.

14. A television receiver as claimed in claim 6, wherein said audio signal is a stereo audio signal having a left channel signal and a right channel signal, said left channel signal being applied to said peaking network and the output of said dipping network carrying a compensated left channel signal, and wherein said equalizing circuit further comprises:

a further input for receiving said right channel signal;

a further peaking network coupled to said further input for augmenting the right channel signal in the first frequency range; and a further dipping network, coupled to an output of said further peaking network, for attenuating the right channel signal in the second frequency range, an output of said further dipping network carrying a compensated right channel signal.

15. A television receiver comprising:

a tuner for receiving and tuning to a television signal;

a video signal processing circuit coupled to a first output of said tuner for processing a video component of said television signal, said video signal processing circuit generating at least one display signal;

display means coupled to said video signal processing circuit for displaying said at least one display signal;

synchronizing signal generating means also coupled to said first output of said tuner for generating synchronizing signals for controlling said display means;

an audio signal processing circuit coupled to a sectional output of said tuner for processing an audio component of said television signal; said audio signal processing circuit generating at least one audio signal;

at least one loudspeaker coupled to an output of said audio signal processing circuit for reproducing the at least one audio signal;

a cabinet within which at least said at least one loudspeaker is mounted; and an equalizing circuit for compensating frequency response perturbations in said at least one loudspeaker caused by a recessed mounting of said at least one loudspeaker in said cabinet, said equalizing circuit comprising:

an input for receiving the audio signal;

a dipping network coupled to said input for attenuating the audio signal in a second frequency range; and a peaking network coupled to an output of said dipping network for augmenting the audio signal in a first frequency range, an output of said peaking network carrying a compensated audio signal for application to said loudspeaker.

16. An equalizing circuit as claimed in claim 15, wherein said first frequency range is higher than said second frequency range.

17. A television receiver as claimed in claim 16, wherein said first frequency range is from 3 kHz to 6 kHz.

18. A television receiver as claimed in claim 16, wherein said second frequency range is from 1 kHz to 2 kHz.

19. A television receiver as claimed in claim 15, wherein said audio signal is a stereo audio signal having a left channel signal and a right channel signal, said left channel signal being applied to said dipping network and the output of said peaking network carrying a compensated left channel signal, and wherein said equalizing circuit further comprises:

a further input for receiving said right channel signal;

a further dipping network coupled to said further input for attenuating the right channel signal in the second frequency range; and a further peaking network coupled to an output of said further dipping network for augmenting the right channel signal in the first frequency range, an output of said further peaking network carrying a compensated right channel signal.

* * * * *